US005403366A

United States Patent [19]

Leininger et al.

[11] Patent Number: 5,403,366

[45] Date of Patent: Apr. 4, 1995

[54] PARTIAL OXIDATION PROCESS FOR PRODUCING A STREAM OF HOT PURIFIED GAS

[75] Inventors: Thomas F. Leininger, Chino Hills; Allen M. Robin, Anaheim; James K. Wolfenbarger, Torrance, all of Calif.; Robert M. Suggitt, Wappingers Falls, N.Y.

[73] Assignee: Texaco Inc., White Plains, N.Y.

[21] Appl. No.: 77,269

[22] Filed: Jun. 17, 1993

[51] Int. Cl.[6] ..... C10J 3/46; C10K 1/32; C10K 1/34

[52] U.S. Cl. ..... 48/197 R; 48/198.3; 48/206; 48/212; 60/39.02; 252/373

[58] Field of Search ..... 48/197 R, 212, 215, 48/206, 209, 198.3, 200, 201; 202/373; 60/39.02; 423/230, 239.1, 240.5

[56] References Cited

U.S. PATENT DOCUMENTS

| | | | |
|---|---|---|---|
| 4,026,679 | 5/1977 | Collin | 48/197 R |
| 4,132,065 | 1/1979 | McGeam et al. | 48/215 |
| 4,189,307 | 2/1980 | Marion | 48/206 |
| 4,202,167 | 5/1980 | Suggitt et al. | 48/42 |
| 4,374,105 | 2/1983 | Anderson et al. | 423/230 |
| 4,436,531 | 3/1984 | Estabrook et al. | 48/206 |
| 4,444,568 | 4/1984 | Beisswenger | 48/206 |
| 4,718,362 | 1/1988 | Satez et al. | 48/203 |
| 4,833,877 | 5/1989 | Okland et al. | 60/39.02 |
| 4,857,285 | 8/1989 | Gal | 423/230 |
| 4,880,439 | 11/1989 | Niyjor et al. | 48/197 R |
| 4,884,396 | 12/1989 | Miyamoto et al. | 423/230 |
| 5,045,522 | 9/1991 | Kidd | 423/230 |
| 5,118,480 | 6/1992 | Cook et al. | 423/24.05 |
| 5,147,415 | 9/1992 | Herbert | 48/197 R |
| 5,213,587 | 5/1993 | Ekstrom et al. | 48/203 |
| 5,227,351 | 7/1993 | Gasper-Galvin et al. | 423/230 |
| 5,243,922 | 9/1993 | Rehmat et al. | 48/210 |
| 5,289,676 | 3/1994 | Brown et al. | 48/206 |

*Primary Examiner*—Peter Kratz

*Attorney, Agent, or Firm*—George J. Darsa; Kenneth R. Priem; Jeffrey M. Greenman

[57] ABSTRACT

A partial oxidation process for the production of a stream of hot clean gas substantially free from particulate matter, alkali metal compounds, hydrogen halides, hydrogen cyanide, sulfur-containing gases, and with or without ammonia for use as synthesis gas, reducing gas, or fuel gas. A pumpable hydrocarbonaceous fuel selected from the group consisting of liquid hydrocarbonaceous fuel or liquid emulsions thereof, an aqueous slurry of petroleum coke, and mixtures thereof and wherein said hydrocarbonaceous fuel contains halides, alkali metal compounds, sulfur, nitrogen and inorganic ash containing components, is reacted in a gasifier by partial oxidation to produce a hot raw gas stream comprising $H_2$, CO, $CO_2$, $H_2O$, $CH_4$, $NH_3$, HCN, HCl, HF, $H_2S$, COS, $N_2$, Ar, particulate matter, vapor phase alkali metal compounds, and molten slag. The hot raw gas stream from the gasifier is cooled in a radiant cooler and cleaned. Optionally, ammonia is removed from the gas stream by being catalytically disproportionated into $N_2$ and $H_2$. The process gas stream is cooled and halides and HCN in the gas stream are reacted with a supplementary alkali metal compound to remove HCl, HF and HCN. Alkali metal halides and alkali metal cyanide, vaporized alkali metal compounds and residual fine particulate matter are removed from the gas stream by further cooling and filtering. The sulfur-containing gases in the process gas stream are then reacted at high temperature with a regenerable sulfur-reactive mixed metal oxide sulfur sorbent material to produce a sulfided sorbent material which is then separated from the hot clean purified gas stream having a temperature of at least 1000° F.

29 Claims, 1 Drawing Sheet

PARTIAL OXIDATION PROCESS FOR PRODUCING A STREAM OF HOT PURIFIED GAS

FIELD OF THE INVENTION

This invention relates to a partial oxidation process for producing hot clean synthesis, reducing, or fuel gas substantially free from entrained particulate matter and gaseous impurities including halides, vapor phase alkali metal compounds, sulfur, hydrogen cyanide, and with or without ammonia.

BACKGROUND OF THE INVENTION

The partial oxidation process is a well known process for converting liquid hydrocarbonaceous and solid carbonaceous fuels into synthesis gas, reducing gas, and fuel gas. See coassigned U.S. Pat. Nos. 3,988,609; 4,251,228, 4,436,530, and 4,468,376 for example, which are incorporated herein by reference. The removal of fine particulates and acid-gas impurities from synthesis gas is described in coassigned U.S. Pat. Nos. 4,052,175, 4,081,253, and 4,880,439; and in 4,853,003; 4,857,285; and 5,118,480 which are all incorporated herein by reference. However, the aforesaid references, as a whole, do not teach nor suggest the subject process for the production of hot clean synthesis gas, reducing gas, and fuel gas which are substantially free from particulate matter, halides, hydrogen cyanide, alkali metal compounds, sulfur-containing gases and with or without ammonia. By the subject process, synthesis gas, reducing gas, and fuel gas having a temperature in the range of about 1000° F. to 1300° F. are produced. Gas produced by the subject process for burning, e.g., fuel gas in the combuster of a gas turbine, will not contaminate the atmosphere. Gas produced for use as a synthesis gas will not deactivate the synthesis catalyst.

SUMMARY

The subject process relates to a partial oxidation process for the production of a stream of hot clean gas substantially free from particulate matter, halides, hydrogen cyanide, alkali metal compounds, sulfur-containing gases, fly-ash and/or molten slag for use as synthesis gas, reducing gas, or fuel gas comprising:

(1) reacting a pumpable hydrocarbonaceous fuel feedstock by partial oxidation with a free-oxygen containing gas wherein said hydrocarbonaceous fuel feedstock is selected from the group consisting of liquid hydrocarbonaceous fuel or liquid emulsions thereof, an aqueous slurry of petroleum coke, and mixtures thereof, and wherein said fuel contains halide, alkali metal compounds, sulfur, nitrogen and inorganic ash containing components, and said fuel is reacted with a free-oxygen containing gas in a free-flow vertical refractory lined partial oxidation gas generator to produce a hot raw gas stream having a temperature in the range of about 1800° F. to 3000° F. and comprising $H_2$, CO, $CO_2$, $H_2O$, $CH_4$, $NH_3$, HCN, HCl, HF, $H_2S$, COS, $N_2$, Ar and containing particulate matter, and vapor phase alkali metal compounds;

(2) partially cooling the hot raw gas stream from (1) to a temperature in the range of about 1000° F. to 1300° F. in a gas cooling zone.

(3) separating out entrained particulate matter from the raw gas stream from (2);

(4) introducing a supplementary alkali metal compound into the process gas stream from (3) to react with hydrogen cyanide and the gaseous halides present in said process gas stream; cooling said process gas stream to a temperature in the range of about 800° F. to 1000° F. and filtering the resulting process gas stream and separating therefrom alkali metal halides and cyanide, any remaining alkali metal compounds, and any remaining particulate matter; and (5) contacting said cooled and filtered gas stream from (4) with a sulfur reactive oxide containing mixed metal oxide sorbent in a sulfur-removal zone, wherein the sulfur-containing gases in said cooled and filtered gas stream from (4) react with said sulfur reactive oxide containing mixed metal oxide sorbent to produce a sulfided sorbent material; and separating said sulfided sorbent material from said cooled and filtered gas stream to produce a clean gas stream substantially free from particulate matter, alkali metal compound, hydrogen halides, hydrogen cyanide, $H_2S$, COS, and having a temperature of at least 1000° F.

In another embodiment, the hot gas stream from (1) is cooled in (2) to a temperature in the range of about 1475° F. to 1800° F. Prior to halide removal in step (4), the $NH_3$ in the process gas stream from (3) is catalytically disproportionated and removed by producing nitrogen and hydrogen gases.

BRIEF DESCRIPTION OF THE DRAWING

The invention will be further understood by reference to the accompanying drawing. The drawing, designated as FIG. 1, is a schematic representation of an embodiment of the process.

DESCRIPTION OF THE INVENTION

Figure 1:
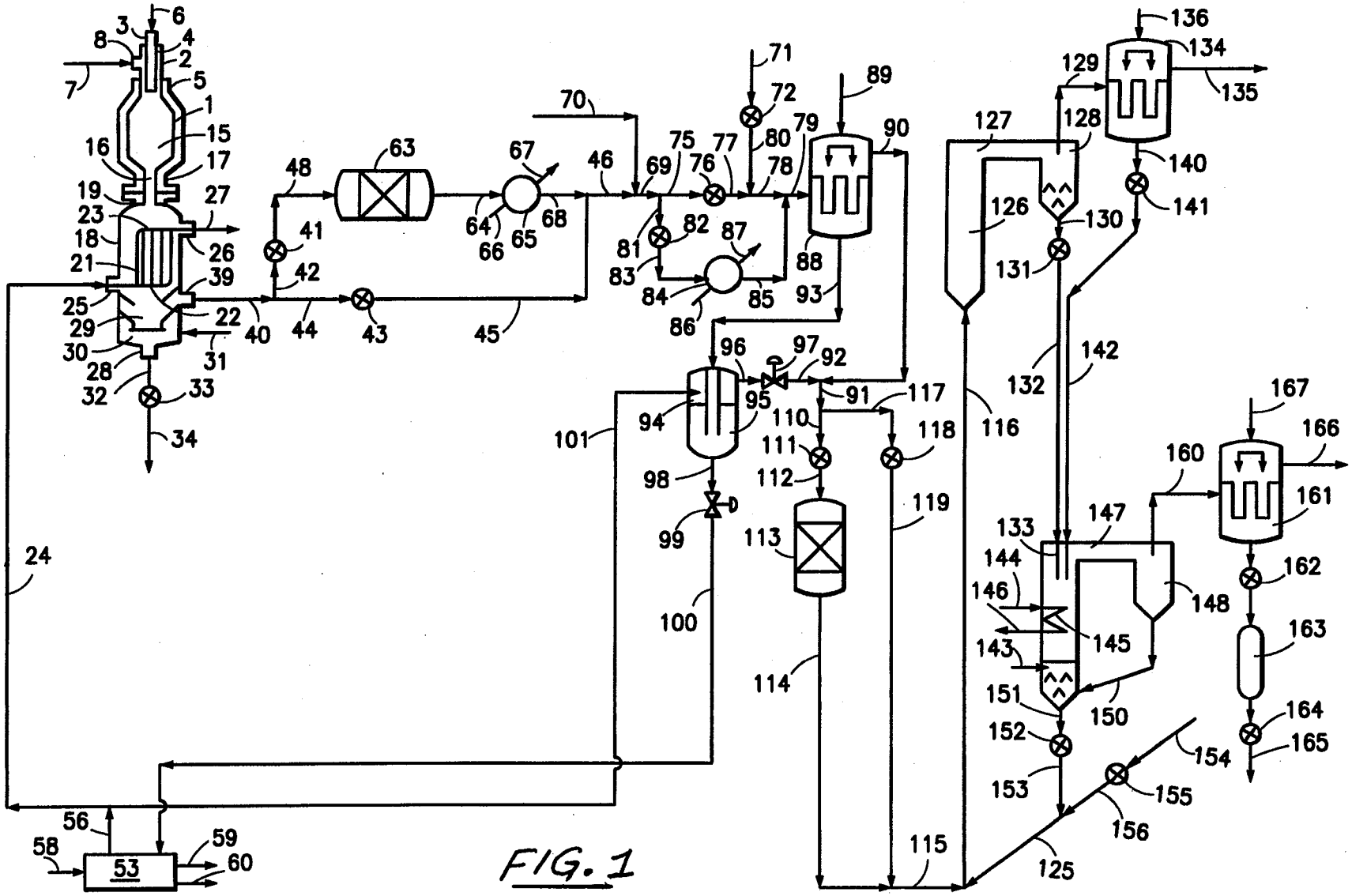

The Texaco partial oxidation gasifier produces raw synthesis, fuel, or reducing gas at temperatures on the order of 1800° to 3000° F. In conventional processes, in order to remove certain contaminants in the stream of raw gas from the gas generator, such as various sulfur species, all of the raw gas produced is cooled down to ambient temperatures or below, as required by the solvent absorption process. Both indirect and direct contact heat exchange methods have been used to accomplish this cooling. However, in all cases, the water in the gas stream is condensed and much of its heat of evaporation is lost. In order to avoid this thermal inefficiency, by the subject process all contaminants are removed from the stream of gas at temperatures well above the adiabatic saturation temperature of the gas. The gas may still be cooled in order to be handled easily, but only to approximately 800° F. to 1800° F., rather than to ambient temperature. Further, in comparison with prior art low temperature gas purification processes, there are larger energy savings with applicants' high temperature gas purification process since the purified gas stream is already hot, and, accordingly, does not require heating prior to introduction into the combustor of a gas turbine for the production of mechanical and/or electrical power. Similarly, when used as a synthesis gas, the process gas stream is already hot.

In the subject process, first a continuous stream of raw gas is produced in the refractory lined reaction zone of a separate downflowing, free-flow, unpacked, noncatalytic, partial oxidation gas generator. The gas generator is preferably a refractory lined vertical steel pressure vessel, such as shown in the drawing, and described in coassigned U.S. Pat. No. 2,992,906 issued to F. E. Guptill, Jr., which is incorporated herein by reference.

The combustible liquid hydrocarbonaceous fuels, aqueous emulsions thereof, and aqueous slurries of petroleum coke containing impurities comprising halide, sulfur, nitrogen, and inorganic ash-containing components are reacted in the gas generator with a free-oxygen containing gas in the presence of a temperature moderating gas to produce the product gas. For example, the liquid hydrocarbonaceous fuel feedstream may comprise a liquid hydrocarbonaceous fuel with or without a gaseous hydrocarbon fuel. The expression A with or without B means any one of the following: A, or A and B. The various types of hydrocarbonaceous fuel may be fed to the partial oxidation gasifier in admixture, or each type of fuel may be fed through a separate passage in a conventional annulus type burner.

The term "hydrocarbonaceous fuel" as used herein to describe various suitable feedstocks is intended to include, pumpable liquid hydrocarbonaceous fuels, pumpable emulsions of liquid hydrocarbonaceous fuels, pumpable aqueous slurries of petroleum coke, and pumpable mixtures thereof. Also included are mixtures of liquid hydrocarbonaceous fuels and gaseous hydrocarbon fuels. The hydrocarbonaceous fuel to the gasifier may have a sulfur content in the range of about 0.1 to 10 weight percent, a halide content in the range of about 0.01 to 1.0 weight percent, and a nitrogen content in the range of about 0.01 to 2.0 weight percent. The sulfur containing impurities may be present as organo sulfur compounds or as the sulfides and/or sulfates of sodium, potassium, magnesium, calcium, iron, aluminum, silicon, and mixtures thereof. The halide impurities may be inorganic chlorine and/or fluorine compounds from the group consisting of sodium, potassium, magnesium, calcium, silicon, iron and aluminum. Organic chlorine and/or fluorine compounds may be also present, such as chlorinated biphenyls or chloro-fluoro compounds. The nitrogen may be present as nitrogen containing inorganic or organic compounds. In addition, relatively minor amounts of vanadium compounds may be present in petroleum based feedstocks. The term "and/or" is used herein in its usual manner. For example A and/or B means either A or B or A and B.

Petroleum coke is produced by any conventional delayed coking process. For example, reference is made to coassigned U.S. Pat. No. 3,852,047 which is incorporated herein by reference. Petroleum coke is preferably ground to a particle size so that 100% of the material passes through an ASTM E 11-70 Sieve Designation Standard 1.4 mm (Alternative No. 14) and at least 80% passes through an ASTM E 11-70 Sieve Designation Standard 0.425 mm (Alternative No. 40). The ground petroleum coke is mixed with water to produce a pumpable aqueous slurry having a dry solids content in the range of about 30 to 65 wt. %.

Gaseous hydrocarbon fuels, as used herein to describe suitable gaseous feedstocks, include methane, ethane, propane, butane, pentane, natural gas, water-gas, coke-oven gas, refinery gas, acetylene tail gas, ethylene off-gas, synthesis gas, and mixtures thereof. Both gaseous, solid, and liquid feeds may be mixed and used simultaneously and may include paraffinic, olefinic, naphthenic, and aromatic compounds as well as bituminous liquids and aqueous emulsions of liquid hydrocarbonaceous fuels, containing about 10 to 40 wt. % water.

Substantially any combustible carbon containing organic material, or slurries thereof, may be included within the definition of the term "hydrocarbonaceous". Suitable liquid hydrocarbonaceous feedstocks include liquefied petroleum gas, petroleum distillates and residues, gasoline, naphtha, kerosine, crude petroleum, asphalt, gas oil, residual oil, tar sand and shale oil, coal oil, aromatic hydrocarbons (such as benzene, toluene, xylene fractions), coal tar, cycle gas oil from fluid-catalytic-cracking operation, furfural extract of coker gas oil, tire-oil, and mixtures thereof.

Also included within the definition of the term "hydrocarbonaceous" are oxygenated hydrocarbonaceous organic materials including carbohydrates, cellulosic materials, aldehydes, organic acids, alcohols, ketones, oxygenated fuel oil, waste liquids, and by-products from chemical processes containing oxygenated hydrocarbonaceous organic materials and mixtures thereof.

The fuel feedstock may be at room temperature, or it may be preheated to a temperature up to as high as about 600° to 1200° F. The fuel feed may be introduced into the burner as a liquid slurry or in an atomized mixture with a temperature moderator. Suitable temperature moderators include $H_2O$, $CO_2$-rich gas, a portion of the cooled clean exhaust gas from a gas turbine that may be employed downstream in the process, by-product nitrogen from the air separation unit, and mixtures of the aforesaid temperature moderators.

The use of a temperature moderator to moderate the temperature in the reaction zone depends in general on the carbon to hydrogen ratio of the feedstock and the oxygen content of the oxidant stream. A temperature moderator is generally not required with aqueous slurries of solid carbonaceous fuels; however, generally one is used with substantially pure oxygen. When a $CO_2$-containing gas stream, e.g., at least about 3 mole percent $CO_2$ (dry basis) is used as the temperature moderator, the mole ratio ($CO/H_2$) of the effluent product stream may be increased. As previously mentioned, the temperature moderator may be introduced in admixture with either or both reactant streams. Alternatively, the temperature moderator may be introduced into the reaction zone of the gas generator by way of a separate conduit in the fuel burner.

When comparatively small amounts of $H_2O$ are charged to the reaction zone, the $H_2O$ may be mixed with either the liquid hydrocarbonaceous or solid carbonaceous feedstock, the free-oxygen containing gas, the temperature moderator, or combinations thereof. The weight ratio of water to hydrocarbonaceous fuel may be in the range of about 0.1 to 5.0, such as about 0.2 to 0.7.

The term "free-oxygen containing gas," as used herein is intended to include air, oxygen-enriched air, i.e., greater than 21 mole percent oxygen, and substantially pure oxygen, i.e., greater than 90 mole percent oxygen (the remainder comprising $N_2$ and rare gases). Free-oxygen containing gas may be introduced into the burner at a temperature in the range of about ambient to 1800° F. The ratio of free oxygen in the oxidant to carbon in the feedstock (O/C, atom/atom) is preferably in the range of about 0.7 to 1.5.

A conventional 2, 3, 4 stream burner may be used to feed the partial oxidation gas generator with the fuel feedstream or feedstreams at a temperature in the range of about ambient to 250° F., the stream of free-oxygen containing gas at a temperature in the range of about ambient to 400° F., and optionally the stream of temperature moderator at a temperature in the range of about ambient to 500° F. In one embodiment, residual oil is passed through the central conduit of a three passage annulus-type burner, a pumpable aqueous slurry of petroleum coke is pumped through the intermediate annular passage, and a stream of free-oxygen containing gas e.g. oxygen is passed through the outer annular passage. For further information, about these burners, reference is made to coassigned U.S. Pat. Nos. 3,743,606; 3,874,592; and 4,525,175, which are incorporated herein by reference.

The feedstreams are reacted by partial oxidation without a catalyst in the reaction zone of a free-flow gas generator at an autogenous temperature in the range of about 1800° to 3000° F. and at a pressure in the range of about 2 to 300 atmospheres absolute (atm. abs.). The reaction time in the gas generator is about 1 to 10 seconds. The mixture of effluent gas leaving the gas generator may have the following composition (mole percent-dry basis) if it is assumed that the rare gases are negligible: CO 15 to 57, $H_2$ 70 to 10, $CO_2$ 1.5 to 50, $NH_3$ 0.02 to 2.0, HCN 0.001 to 0.02, HCl 0.001 to 1.0, HF 0.001 to 0.5, $CH_4$ 0.001 to 20, $N_2$ nil to 75, Ar nil to 2, $H_2S$ 0.01 to 5.0, and COS 0.002 to 1.0. Also entrained in the effluent gas stream from the gas generator is particulate matter comprising a material selected from the group consisting of particulate carbon and fly-ash. Included within the definition of particulate matter are droplets of molten sticky slag which include alkali metal compounds which are selected from the group consisting of aluminosilicates, silicates, aluminates, sulfides, sulfates, halides, and hydroxides of sodium and/or potassium. The alkali metal compound particulate matter may be present up to about 5.0 wt. % of the particulate matter. The effluent gas stream from the gasifier may also contain up to about 200 ppm of vapor phase alkali metal compounds which are selected from the group consisting of hydroxides and halides of sodium and/or potassium, as well as metallic Na and/or K vapor. Unreacted particulate carbon (on the basis of carbon in the feed by weight) is about 0.05 to 20 weight percent.

A stream of hot raw effluent gas leaves through the central converging refractory lined bottom outlet in the reaction zone of the gas generator and passes down through a coaxial vertical refractory lined connecting duct and through a conventional radiant cooler located below in line with the central axis of the gas generator. A suitable radiant cooler is shown in coassigned U.S. Pat. No. 4,377,132, which is incorporated herein by reference.

In the preferred embodiment, the $NH_3$ in the product gas stream may be tolerated. In such case, the process gas stream is cooled in the radiant cooler to a temperature in the range of about 1000° F. to 1300° F. No $NH_3$ removal step is required in this embodiment; and, the cooled process gas stream leaving the radiant cooler is immediately dehalogenated.

In a second embodiment, for example, when the organic nitrogen in the hydrocarbonaceous fuel exceeds 0.1 wt. % of $N_2$, it may be desirable to remove the ammonia from the process gas stream. In such case, the process gas stream is made to leave the radiant cooler at a temperature in the range of about e.g. 1475° F. to 1800° F. Prior to being dehalogenated the process gas stream goes to a catalytic disproportionator where the $NH_3$ in the process gas stream is converted into $N_2$ and $H_2$. The $NH_3$-free process gas stream is then dehalogenated. Accordingly, in this second embodiment, the process gas stream leaves the radiant cooler at a temperature in the range of about 1475° F. to 1800° F., say about 1500° F., and contains particulate matter and the following gaseous impurities: $NH_3$, HCN, hydrogen halides, and vaporized alkali metal compounds, $H_2S$ and COS. In one embodiment, the process gas stream is passed through a gas/solids separating zone, such as ceramic filter, to reduce the particulate matter in the raw gas stream to less than 1000 parts per million by weight (wppm).

When desired, $NH_3$ is the first gaseous impurity that is removed from the process gas stream. Ammonia is removed first while the temperature of the gas stream is at 1475° F. or higher. At this temperature, the disproportionating catalyst is tolerant to sulfur in the gases. Further, the disproportionating reaction is favored by high temperatures. The nitrogen-containing compounds in the fuel feedstock to the partial oxidation reaction zone are converted into $NH_3$, HCN, and $N_2$. Removal of $NH_3$ and HCN from a stream of gas will reduce the production of $NO_x$ gases during the subsequent combustion of the gas. In the next step of the process, in a high temperature $NH_3$ decomposition catalytic reactor, the $NH_3$ present in the reaction zone is disproportionated into $N_2$ and $H_2$. Over 90 wt. % of the hydrogen cyanide is destroyed by contact with the ammonia disproportionator catalyst. One mechanism for this is by hydrolysis with the moisture in the synthesis gas to produce $NH_3$ and CO followed by subsequent disproportionation of the ammonia. Another mechanism is by hydrogenation of the HCN in the disproportionator chamber to form methane and nitrogen. Any residual HCN after the disproportionation step is removed in the following halide removal step as an alkali metal cyanide. The expression "substantially $NH_3$ free" and "$NH_3$ free" as used herein means less than 150 to 225 volumetric parts per million (vppm) of $NH_3$. For example, the stream of gas having an inlet concentration of $NH_3$ in the range of about 500 and 5000 vppm (volumetric parts per million), say about 1900 vppm, and at a temperature in the range of about 1475° F. to 1800° F. and, at a pressure which is substantially that as provided in the reaction zone of the gas generator, less ordinary pressure drop in the lines, e.g., a pressure drop of about 0.5 to 3 atms., is passed through a fixed bed catalytic reactor where $NH_3$ in the gas stream is disproportionated to $N_2$ and $H_2$. Readily available conventional nickel catalysts may be used. For example, HTSR-1 catalyst supplied by Haldor-Topsoe A/S, Copenhagen, Denmark and described in U.S. Department of Energy Morgantown, W. Va. Report DE 89000945, September 1988, which is incorporated herein by reference. The space velocity is in the range of about 3000 to 100,000 $h^{-1}$ (say, about 20,000 $h^{-1}$) at NTP. The catalyst is resistant to deactivation by halides and sulfur-containing gases at temperatures above 1475° F.

In the dehalogenation step of the process, halides along with any HCN present are removed from the process gas stream to produce a gas stream free from halides and hydrogen cyanide and with or without $NH_3$. Gaseous halides are removed from the process gas stream prior to the final desulfurization step in order to prevent gaseous halide absorption by the desulfurization sorbent material, and thereby deactivation of the sorbent material. The terms "substantially halide-free or HCN-free," "halide-free or HCN-free," or "free from" halides or HCN, as used herein mean less than 1 vppm of hydrogen halides or HCN. Gaseous hydrogen halides, e.g., HCl and HF, along with hydrogen cyanide, are removed by cooling the process gas stream to a temperature in the range of about 1000° F. to 1300° F. prior to being contacted with a supplementary alkali metal compound or mixtures thereof, wherein the alkali metal portion of said supplementary alkali metal compound is at least one metal selected from Group 1A of the Periodic Table of the Elements. For example, the carbonates, bicarbonates, hydroxides and mixtures thereof of sodium and/or potassium, and preferably $Na_2CO_3$, may be injected into the cooled process gas stream with or without $NH_3$. The supplementary alkali metal compound from an external source may be introduced as an aqueous solution or as a dry powder. Sufficient supplementary alkali metal is introduced so that substantially all of the gaseous halides, such as HCl and HF and the HCN, react to form alkali metal halides and alkali metal cyanide, such as NaCl and NaF and NaCN. For example, the equivalent of the alkali metal component should exceed the sum of the equivalents of HCl, HF and HCN by a ratio of about 5-1 to 1, such as 2 to 1.

To separate the alkali metal halides and cyanide from the gas stream, the gas stream is cooled to a temperature in the range of about 800° F. to 1000° F., by direct contact with a water spray, or, alternatively, by indirect heat exchange with a coolant. As the syngas cools to 800° to 1000° F., the alkali metal halide and cyanide particles agglomerate along with the other very fine particles which passed through the previous steps. The cooled gas is then filtered with a conventional high temperature ceramic filter, such as a ceramic candle filter, in order to remove the alkali metal halides and cyanide, and other particles such as the remaining alkali metal compounds and any remaining particulate matter such as particulate carbon or fly-ash. Over time, a dust cake of very fine particles accumulates on the dirty side of the ceramic filter. Periodically, the filter is back-pulsed with a gas such as nitrogen, steam or recycled syngas in order to detach the dust cake from the ceramic filter elements and to cause the detached cake to drop into the bottom of the filter vessel. In order to prevent re-entrainment of the very fine dust particles, a slip-stream of the cooled gas stream entering the filter is withdrawn through the bottom of the filter vessel into a quench tank. The volume of said slip-stream of gas is about 0.1 to 10.0 volume percent of the gas stream entering the filter. The remainder of the syngas passes through the ceramic filter elements and exits the filter free of halides, cyanide, alkali metal compounds and virtually all other compounds which are solid particulates in the filtration temperature range of 800° F. to 1000° F. The combined stream, consisting of the small slip-stream of syngas and the fine dust cake which is periodically detached from the ceramic filter elements, is quenched with water. The various compounds and particles in the dust cake either dissolve or are suspended in the quench water. The resulting gas stream free from halide, HCN, alkali metal compounds, particulate matter, and with or without $NH_3$ leaves the quench zone, passes through a flow control valve, and is mixed with the overhead stream of gas free from halide, HCN, alkali metal compounds, and with or without $NH_3$ leaving the gas filtration zone. The temperature of this process gas stream is in the range of about 800° F. to 1000° F. The pressure is substantially that in the partial oxidation reaction zone, less ordinary pressure drop in the lines, e.g. about 1 to 4 atms.

In the next gas purification step, the process gas stream is desulfurized in a conventional high temperature gas desulfurization zone. However, in order for the desulfurization reactions to proceed at a reasonable rate, the gas stream free from particulate matter, alkali metal compounds, halides, HCN, and with or without $NH_3$ should be at a temperature in the range of 1000° F. to 1250° F. If the gas has been cooled to only 1000° F. in the preceding cooling and filtering step, then no reheating would normally be required. But if the gas was cooled to 800° F. in the preceding step, then it should be reheated using one of the following methods.

Heating the gas stream free from particulate matter, alkali metal compound, halides, HCN and with or without $NH_3$ to a temperature in the range of about 1000° F. to 1250° F. while simultaneously increasing its mole ratio of $H_2$ to CO may be done in a catalytic exothermic water-gas shift reactor using a conventional high temperature sulfur resistant shift catalyst, such as a cobalt-molybdate catalyst. For example, the mole ratio of $H_2O$ to dry gas in the water-gas shift reactor is at least 0.1. Simultaneously, the $H_2$/CO mole ratio of the hydrogen and carbon monoxide in the feed gas stream to the shift reactor is increased. For example, the shifted gas stream may have a $H_2$CO mole ratio in the range of about 1.0–17/1. Alternatively, the temperature of the process gas stream may be increased to the desired temperature by passing the process gas stream over a conventional high temperature sulfur resistant methanation catalyst, such as ruthenium on alumina. Another suitable method for increasing the temperature of the process gas stream by indirect heat exchange. By this means, there is no change in gas composition of the portion of the process gas stream being heated.

The heated gas stream free from particulate matter, alkali metal compound, halides, HCN and with or without $NH_3$ at a temperature in the range of about 1000° F. to 1250° F. is mixed with regenerated sulfur-reactive mixed metal oxide sorbent material, such as zinc titanate, at a temperature in the range of about 1000° F. to 1450° F. and the mixture is introduced into a fluidized bed. Mixed metal oxide sulfur absorbent materials comprise at least one, such as 1 to 3, sulfur reactive metal oxides and about 0 to 3 nonsulfur reactive metal oxides. Greater than 99 mole percent of the sulfur species in the process gas stream are removed external to the partial oxidation gas generator in this fluidized bed. The term "zinc titanate sorbent" is used to describe mixtures of zinc oxide and titania in varying mole ratios of zinc to titanium in the range of about 0.5–2.0/1, such as about 1.5. At a temperature in the range of about 1000° F. to 1250° F., and at a pressure of that in the gas generator in (1) less ordinary pressure drop in the lines, the sulfur containing gases, e.g., $H_2S$ and COS, in the process gas stream react in said fluidized bed with the reactive oxide portion, e.g. zinc oxide, of said mixed metal oxide sulfur sorbent material to produce a sulfided sorbent material comprising solid metal sulfide material and the remainder, e.g. titanium dioxide, of said sorbent material. In addition to the desulfurization reactions, mixed metal oxide sulfur sorbents such as zinc titanate also catalyze the water-gas shift reaction essentially to completion in the same range of temperatures at which desulfurization takes place. Because there can be an appreciable amount of water in the syngas at the desulfurizer inlet, the shift reaction will proceed simultaneously with the desulfurization reactions in the fluidized bed desulfurizer. This will be the case even if a shift catalyst reactor is used as a reheating step prior to the desulfurizer. The desulfurization and shift reactions are exothermic, and the released heat will tend to raise the temperature of the syngas and sorbent. The temperature of the sorbent, however, must be prevented from exceeding about 1250° F. in order to minimize reduction, volatilization and loss of the reactive metal component, e.g. zinc, of the sorbent. It is important to remove any alkali metal halide from the syngas prior to contact with the sulfur sorbent. For example, with a zinc titanate sorbent, volatile zinc halide could be formed during the subsequent regeneration step. If the amount of heat released by the desulfurization and shift reactions would tend to raise the temperature of the fluidized bed above about 1250° F., internal cooling coils may be employed in order to prevent the temperature of the mixed metal oxide sorbent from exceeding 1250° F. Alternatively, if the temperature of the syngas is, say 1000° F. at the desulfurizer inlet, and if the composition of the syngas is such that the heat from the desulfurization and shift reactions will not raise the temperature of the syngas above 1250° F., then no fluidized bed internal cooling coils are needed. The reactive metal oxide portion of said mixed metal oxide sulfur sorbent material is selected from the group consisting of Zn, Fe, Cu, Ce, Mo, Mn, Sn, and mixtures thereof. The non-reactive oxide portion of said sulfur sorbent material may be an oxide and/or an oxide compound selected from the group consisting of titanate, aluminate, aluminosilicates, silicates, chromites, and mixtures thereof.

The overhead from the fluidized bed desulfurizer is introduced into a conventional high temperature gas-solids separating zone, e.g., cyclone separator, where entrained sulfided sulfur sorbent particles are removed from the gas leaving the fluidized bed desulfurizer. A suitable high temperature cyclone is shown in coassigned U. S. Pat. No. 4,328,006, which is incorporated herein by reference. The overhead stream from the separating zone comprises halide-free, HCN-free, alkali metal compound-free, sulfur-free gas, and optionally ammonia free. Any remaining particulate matter entrained from the fluidized bed may be removed from this gas stream in a conventional high temperature ceramic filter such as a ceramic candle filter, which removes all remaining particles. The exit concentrations of sulfur species in the sulfur-free product gas stream is less than 25 vppm, say 7 vppm. Depending upon the type and amount of gaseous constituents, and the use it is put to, the product gas stream may be referred to as synthesis gas, fuel gas, or reducing gas. For example, the mole ratio $H_2/CO$ may be varied for synthesis gas and reducing gas, and the $CH_4$ content may be varied for fuel gas. The sulfided sorbent exiting from the bottom of high temperature cyclone and from the bottom of the ceramic filter has a sulfur loading of about 5–20 weight percent and a temperature of about 1000° F. to 1250° F. It is then introduced into a conventional fluidized bed regenerator where the metal sulfide is roasted, reacted with air at a temperature in the range of about 1000° F. to 1450° F., and reconverted into said sulfur-reactive mixed metal oxide sorbent material which is recycled to said external high temperature gas desulfurization zone in admixture with said sulfur containing process feed gas which is free from particulate matter, halide, HCN, alkali metal compound, and with or without $NH_3$.

In one embodiment, regenerated zinc titanate powder is injected into said gas stream free from particulate matter, halide, HCN, alkali metal compound, and with or without ammonia at a temperature in the range of about 1000° F. to 1250° F. Then the gas-solids mixture is introduced into the fluidized bed desulfurizer. The rate of injection of zinc titanate powder into the stream of gases being desulfurized is sufficient to ensure complete desulfurization. The fluidized bed of zinc titanate (converted at least in part to the sulfided form of the sorbent) is carried over with the desulfurized gas stream to a cyclone separator where spent zinc titanate is separated and flows down into the regenerator vessel. The hot desulfurized overhead gas stream from the cyclone separator is filtered and cleaned of any residual solids material and then burned in the combustor of a gas turbine for the production of flue gas with a reduced $NO_x$ content and free from particulate matter, halides, alkali metal compound and sulfur-containing gases. The flue gas is then passed through an expansion turbine for the production of mechanical and/or electrical power. After heat exchange with boiler feed water to produce steam, the spent flue gas may be safely discharged into the atmosphere. In one embodiment, the by-product steam may be passed through a steam turbine for the production of mechanical and/or electrical energy. All of the fine solids separated from the sulfur-free gas stream are returned to the fluidized bed regenerator where the sulfide particles are oxidized by air at a temperature in the range of about 1000° F. to 1450° F. Regenerated sorbent entrained in air and $SO_2$ are carried over to a second cyclone separator. The fine solids that are separated from the stream of gases in the cyclone separator are recycled to the fluidized bed regenerator. The gaseous overhead from the cyclone separator is filtered and the clean $SO_2$-containing gas stream containing about 5.5 to 13.5 mole % $SO_2$, e.g. 11.3 mole % $SO_2$ at a temperature in the range of about 1000° F. to 1450° F. may be cooled, depressurized and used in well known processes for producing sulfuric acid e.g. Monsanto Chemical Co. contact process.

DESCRIPTION OF THE DRAWING

A more complete understanding of the invention may be had by reference to the accompanying schematic drawing FIG. 1, which shows the process in detail. Although the drawing illustrates a preferred embodiment of the process of this invention, it is not intended to limit the continuous process illustrated to the particular apparatus or materials described.

As shown in the drawing FIG. 1, vertical free-flow non-catalytic refractory lined gas generator 1 is equipped with conventional annulus type burner 2 having coaxial central and annular passages 3 and 4 respectively. While a two stream annular-type burner is shown herein, it is understood that other suitable conventional burners with a plurality of separate passages may be used to accommodate two or more separate feedstreams. Burner 2 is mounted in the upper central inlet 5 of generator 1. Central passage 3 is connected to a mixed stream of free oxygen containing gas and steam in line 6. A pumpable stream of liquid hydrocarbonaceous fuel is passed through line 7, inlet 8 and into the annular passage 4. The streams of free-oxygen containing gas in admixture with steam and the liquid hydrocarbonaceous fuel impact together, atomize, and react together by partial oxidation in reaction zone 15 of gas generator 1 to produce a hot raw gas comprising: $H_2$, CO, $CO_2$, $H_2O$, $CH_4$, $NH_3$, HCN, HCl, HF, $H_2S$, COS, $N_2$, Ar, and containing particulate matter and vapor phase alkali metal compounds. The hot process gas stream leaves reaction zone 15 through downstream central refractory lined exit passage 16 of reaction zone 15 and passes down through radiant cooler 18.

Vertical radiant cooler 18 is mounted beneath gas generator 1 by connecting upper central flanged inlet 19 of radiant cooler 18 to downstream central flanged outlet 17 of gas generator 1. Central refractory lined passage 16 continues into radiant cooler 18. Radiant cooler 18 is a hollow vertical cylindrically shaped steel pressure vessel with a plurality of concentric vertical rings of parallel vertically spaced tubes 21 each connected to a bottom feed manifold 22. The plurality of vertical tubes are connected at the top to upper manifold 23. Boiler feed water enters bottom feed manifold 22 by way of line 24 and flanged inlet 25. Steam is removed from upper manifold 23 by way of flanged outlet 26 and line 27.

As the hot raw process gas stream passes down and over the rings of tubes 21, the raw gas stream is cooled and particulate matter e.g. soot, fly-ash, and molten slag separate out, for example by gravity, in gas-solids baffled separation zone 29 and are collected in a pool of water 30 at the bottom of radiant cooling vessel 18. Fresh water is introduced through line 31 at the bottom of vessel 18. An aqueous dispersion of solids is removed through central bottom outlet 28, line 32, valve 33, and line 34.

In a first embodiment, no provision is made to remove $NH_3$ so the hot raw process gas stream leaves radiant cooler 18 through side outlet 39 and line 40. With valve 41 in line 42 closed and valve 43 in line 44 open, the raw process gas stream is passed through lines 45 and 46 and mixed in line 69 with an alkali metal compound e.g. $Na_2CO_3$ which is injected from line 70.

In a second embodiment with valve 43 closed, the raw process gas stream in line 40 is passed through line 42, open valve 41, and line 48 into catalytic disproportionator 63 where $NH_3$ in the process gas stream is converted into $N_2$ and $H_2$. In one embodiment, not shown, the raw process gas stream in line 48 is passed through a ceramic filter to reduce the content of particulate matter in the gas stream prior to entering disproportionator 63. The raw process gas stream in line 64, free from $NH_3$, is passed through heat exchanger 65 and cooled by indirect heat exchange with a coolant which enters through line 66 and leaves through line 67. The cooled raw process gas stream free from $NH_3$ is passed through line 46 and mixed in line 69 with alkali metal compound e.g. $Na_2CO_3$ which is injected from line 70.

With valve 82 in line 81 closed, the process gas mixture in line 69 is cooled as it is passed through line 75, open valve 76, line 77, and, optionally, mixed in lines 78 and 79 with water from line 71, valve 72, and line 80. Optionally, with valve 76 closed and valve 82 open, the stream of gas in line 69 may be cooled by passage through line 81, valve 82, line 83, cooler 84 and line 85. In cooler 84, boiler feed water in line 86 is converted into saturated steam which leaves through line 87.

An alkali metal halide compound, e.g., NaCl and/or NaF and NaCN in solid form is separated from the gas stream in filter vessel 88. A back-flushing stream of nitrogen gas is periodically introduced into filter vessel 88 by way of line 89 to pulse-clean the filters. Substantially halide and HCN-free gas stream leaves filter 88 through line 90 and is mixed in line 91 with cleaned slip stream of gas from line 92. Alkali metal halides e.g. NaCl, NaF, and NaCN in solid form plus other solid alkali metal compounds and residual fine particulate matter in a small slip stream of gas from filter chamber 88 is passed through line 93 into quench chamber 94 where the alkali metal halides and cyanide, other alkali metal compounds, and residual particulate matter dissolve or are suspended in water 95. The halide-free and optionally $NH_3$-free slip stream of gas from quench chamber 94 is passed through line 96, valve 97, and line 92. Quench water 95 leaves chamber 94 and passes into conventional water recovery zone 53 by way of line 98, valve 99, and line 100. Quench water from line 34 is also passed into conventional quench water recovery zone 53. Recycle water is passed through lines 56, 24, and 101 into the respective quench vessels.

The stream of gas in line 91 which is substantially free from particulate matter, halide, HCN, alkali metal compound, and with or without $NH_3$, is, optionally, at least in part water-gas shifted by being passed through line 110, valve 111, line 112, shift catalyst chamber 113, line 114 and 115. If the process gas stream being fed to the water-gas shift reaction zone is deficient in water, supplementary water may be introduced into the gas stream in the following manner: (1) as aqueous $Na_2CO_3$ solution in line 70; (2) coolant water through line 71, valve 72 and line 80; and (3) water quenched gas stream in line 96. Alternatively, at least a portion of the stream of gas in line 91 may by-pass shift catalyst chamber 113 by passing through line 117, valve 118, and line 119. In another embodiment, shift catalyst chamber 113 is replaced with a methanation catalyst chamber.

A sulfur reactive mixed metal oxide sorbent material, such as zinc titanate, from line 125 is mixed in line 116 with the stream from line 115. Then the mixture is introduced into a fluidized bed reactor 126 where the gas stream is desulfurized at an elevated temperature, e.g. 1000° F. to 1250° F. For example, as shown in FIG. 1, contacting vessel 126 is a fluidized bed and at least a portion of the sulfur-reactive portion of said mixed metal oxide material reacts with sulfur-containing gas in said gas stream from line 115 and is converted into a solid metal sulfide-containing material. A gas stream substantially free from halide, hydrogen cyanide, alkali metal compound, $H_2S$, COS and sulfur and having entrained solid metal sulfide-containing particulate sorbent material is produced and passed through overhead passage 127 into conventional gas-solids separator 128, e.g., cyclone separator. A gas stream free from halides, hydrogen cyanide, alkali metal compound, sulfur, and with or without $NH_3$ at a temperature of at least 1000° F. is removed from separator 128 by way of overhead line 129. Spent solid metal sulfide-containing particulate sorbent material is removed from gas-solids separator 128 by way of bottom line 130, valve 131, line 132, and is introduced into sulfided particulate sorbent regenerator vessel 133. In one embodiment, any solid metal sulfide-containing sorbent material remaining in the gas stream in line 129 is filtered out in conventional high temperature ceramic filter 134 to produce a hot clean gas stream which is substantially free from particulate matter, hydrogen, halide, hydrogen cyanide, alkali metal compounds, $H_2S$, COS, and with or without $NH_3$ in line 135 having a temperature of at least 1000° F. A clean upgraded fuel gas stream in line 135, preferably without $NH_3$, may be introduced into the combustor of a combustion turbine for the production of electrical and/or mechanical power. In another embodiment, clean ungraded synthesis gas in line 135 is introduced into a catalytic reaction zone for the chemical synthesis of organic chemicals, e.g., methanol. Nitrogen in line 136 is used to periodically back flush and clean ceramic filter 134. The nitrogen may be obtained as a by-product from a conventional air separation unit used to make substantially pure oxygen from air. The oxygen is fed to the partial oxidation gas generator.

Spent solid metal sulfide-containing particulate sorbent material is removed from gas-solids separator 134 by way of line 140, valve 141, line 142, and introduced into metal sulfide-containing particulate sorbent regenerator vessel 133. For example, regenerator vessel 133 may be a conventional bubbling or circulating fluidized bed with air being introduced through line 143. The air may be obtained as a slip-stream from the air compressor of the downstream combustion turbine in which the clean fuel gas is combusted to produce mechanical and/or electrical power. Optionally, in order to prevent build-up of sorbent fines, a bleed-stream of the material in line 140 may be removed from the system. Boiler feed water is passed through line 144 and coil 145, and exits as saturated steam through line 146. The metal sulfide-containing sorbent is oxidized by the air from line 143 to produce sulfur dioxide and sulfur reactive metal oxide-containing sorbent particulates which are entrained with the gases that pass through passage 147 into gas-solids separator 148. For example, gas-solids separator 148 may be a cyclone separator. Reconverted sulfur-reactive metal oxide-containing material is passed through line 150 and recycled to the bottom of regenerator vessel 133 and then through line 151, valve 152, lines 153, 125 to line 116 where it is mixed with the sulfur-containing gas stream from line 115. Make-up sulfur-reactive metal oxide-containing material is introduced into the process by way of line 154, valve 155, and line 156. A gas stream substantially comprising $N_2$, $H_2O$, $CO_2$, $SO_2$ and particulate matter leaves separator 148 through overhead line 160 and is introduced into high temperature ceramic filter 161 where fine regenerated sulfur-reactive metal oxide-containing material is separated and removed through valve 162, lock hopper chamber 163, valve 164 and line 165. The hot stream of clean sulfur-containing gas is discharged through line 166 and sent to a conventional sulfur recovery unit (not shown). Periodically, nitrogen is passed through line 167 for reverse flushing and cleaning the ceramic filter.

Other modifications and variations of the invention as hereinbefore set forth may be made without departing from the spirit and scope thereof, and therefore only such limitations should be imposed on the invention as are indicated in the appended claims.

We claim:

1. A partial oxidation process for producing hot, clean synthesis gas, reducing gas, or fuel gas substantially free from particulate matter, hydrogen halides, hydrogen cyanide, alkali metal compounds, and sulfur-containing gases, comprising:

(1) reacting a pumpable hydrocarbonaceous fuel feedstock by partial oxidation with a free-oxygen containing gas wherein said hydrocarbonaceous fuel feedstock comprises a fuel selected from the group consisting of liquid hydrocarbonaceous fuel or liquid emulsions thereof, an aqueous slurry of petroleum coke, and mixtures thereof, and wherein said fuel contains halide, alkali metal compounds, sulfur, nitrogen and inorganic ash containing components, and said fuel is reacted with a free-oxygen containing gas in a free-flow vertical refractory lined partial oxidation gas generator to produce a hot raw gas stream having a temperature in the range of about 1800° F. to 3000° F. and comprising $H_2$, CO, $CO_2$, $H_2O$, $CH_4$, $NH_3$, HCN, HCl, HF, $H_2S$, COS, $N_2$, Ar and containing particulate matter, and vapor phase alkali metal compounds;

(2) partially cooling the hot raw gas stream from (1) to a temperature in the range of about 1000° F. to 1300° F. in a gas cooling zone;

(3) separating out entrained particulate matter from the raw gas stream from (2);

(4) introducing a supplementary alkali metal compound into the gas stream from (3) to react with the gaseous hydrogen halides and hydrogen cyanide present in the gas stream; cooling the resulting gas stream to a temperature in the range of about 800° F. to 1000° F. and filtering the gas stream and separating therefrom alkali metal halides and cyanide, any remaining alkali metal compounds, and any remaining particulate matter; and (5) contacting the gas stream from (4) with a sulfur reactive oxide containing mixed metal oxide sorbent comprising a sulfur reactive oxide portion and a sulfur non-reactive oxide portion in a sulfur-removal zone, wherein the sulfur-containing gases in the gas steam from (4) react with said sulfur reactive oxide containing mixed metal oxide sorbent to produce a sulfided sorbent material; and separating said sulfided sorbent material from the gas stream to produce a clean gas stream substantially free from particulate matter, alkali metal compounds, hydrogen halides, HCN, $H_2S$, and COS, and having a temperature of at least 1000° F.

2. The process of claim 1 further comprising the step of filtering the gas stream from (5) to remove any remaining solid sulfided sorbent material.

3. The process of claim 1 wherein said liquid hydrocarbonaceous fuel is selected from the group consisting of liquified petroleum gas, petroleum distillates and residues, gasoline, naphtha, kerosine, crude petroleum, asphalt, gas oil, residual oil, tar sand and shale oil, coal oil, aromatic hydrocarbons, coal tar, cycle gas oil from fluid-catalytic-cracking operation, furfural extract of coker gas oil, tire-oil, and mixtures thereof.

4. The process of claim 1 wherein said hydrocarbonaceous fuel has a sulfur content in the range of about 0.1 to 10 wt. %, a halide content in the range of about 0.01 to 1.0 wt. %, and a nitrogen content in the range of about 0.01 to 2.0 wt. %.

5. The process of claim 1 wherein the sulfur containing components in said fuel feedstock in (1) are selected from the group consisting of organic sulfur compounds, sulfides or sulfates selected from the group consisting of Na, K, Ca, MG, Fe, Al, Si, and mixtures thereof.

6. The process of claim 1 wherein halide components in said fuel feedstock in (1) are selected from the group consisting of chlorine or fluorine compounds selected from the group consisting of Na, K, Ca, Mg, Al, Fe, Si, and organic chlorine or fluorine compounds, and mixtures thereof.

7. The process of claim 1 wherein the nitrogen component in said fuel feedstock in (1) is selected from the group consisting of nitrogen containing inorganic compounds, organic compounds, and mixtures thereof.

8. The process of claim 1 where in (4) the alkali metal in said supplementary alkali metal compound is at least one metal selected from Group 1A of the Periodic Table of the Elements.

9. The process of claim 1 where in (4) said supplementary alkali metal compound is selected from the group consisting of carbonates, bicarbonates, hydroxides and mixtures thereof of sodium or potassium, and mixtures thereof.

10. The process of claim 1 where in (4) dry powdered $Na_2CO_3$ or an aqueous solution of $Na_2CO_3$ is introduced into the gas stream from (3) as said supplementary alkali metal compound.

11. The process of claim 1 further comprising the step of passing the gas stream leaving (4) through a catalytic water-gas shift reaction zone and thereby heating the gas stream to a temperature in the range of about 1000° F. to 1250° F. prior to (5).

12. The process of claim 11 further comprising the step of introducing supplemental water into the gas stream prior to said water-gas shift reaction zone.

13. The process of claim 11 wherein the $H_2/CO$ mole ratio of the shifted gas stream is in the range of about 1.0–17/1.

14. The process of claim 1 further comprising the step of passing the gas stream leaving (4) through a catalytic methanation reaction zone and thereby heating the gas stream to a temperature in the range of about 1000° F. to 1250° F. prior to (5).

15. The process of claim 1 where in (3) the gas stream contains not more than 1000 wppm of particulate matter.

16. The process of claim 1 further comprising the step of heating the stream of gas leaving (4) to a temperature in the range of about 1000° F. to 1250° F. by indirect heat exchange prior to (5).

17. The process of claim 1 where in (5) the sulfur-reactive metal oxide portion of said sulfur-reactive mixed metal oxide sulfur sorbent material is selected from the group consisting of Zn, Fe, Cu, Ce, Mo, Sn, and mixtures thereof.

18. The process of claim 1 where in (5) the non-reactive oxide portion of said sulfur-reactive mixed metal oxide sorbent material is an oxide and/or an oxide compound selected from the group consisting of titanate, aluminate, aluminosilicates, silicates, chromites, and mixtures thereof.

19. The process of claim 1 where in (5) $H_2S$ and COS in the gas stream from (4) at a temperature in the range of about 1000° F. to 1250° F. and at a pressure of that in the gas generator in (1) less ordinary pressure drop in the lines react with the sulfur-reactive portion of said sulfur-reactive mixed metal oxide material.

20. The process of claim 1 provided with the step of roasting said sulfided sorbent material separated in (5), regenerating said sulfur-reactive mixed metal oxide sorbent material, and separating said sulfur-reactive mixed metal oxide sorbent material for use in (5) from a $SO_2$-containing gas stream.

21. The process of claim 20 further comprising the steps of filtering said $SO_2$-containing gas stream, and using the filtered $SO_2$-containing gas stream to make sulfuric acid.

22. The process of claim 1 wherein said hydrocarbonaceous fuel feedstock further comprises a gaseous hydrocarbon fuel selected from the group consisting of methane, ethane, propane, butane, pentane, natural gas, water-gas, coke-oven gas, refinery gas, acetylene tail gas, ethylene off-gas, synthesis gas, and mixtures thereof.

23. A partial oxidation process for the production of a stream of hot clean synthesis gas, reducing gas, or fuel gas substantially free from particulate matter, hydrogen halides, alkali metal compounds, $NH_3$, HCN, and sulfur-containing gases comprising:

(1) reacting a pumpable hydrocarbonaceous fuel feedstock by partial oxidation with a free-oxygen containing gas wherein said hydrocarbonaceous fuel feedstock comprises a fuel selected from the group consisting of liquid hydrocarbonaceous fuel or liquid emulsions thereof, an aqueous slurry of petroleum coke, and mixtures thereof, and wherein said fuel contains halide, alkali metal compounds, sulfur, nitrogen and inorganic ash containing components, and said fuel is reacted with a free-oxygen containing gas in a free-flow vertical refractory lined partial oxidation gas generator to produce a hot raw gas stream having a temperature in the range of about 1800° F. to 3000° F. and comprising $H_2$, CO, $CO_2$, $H_2O$, $CH_4$, $NH_3$, HCN, HCl, HF, $H_2S$, COS, $N_2$, Ar and containing particulate matter, and vapor phase alkali metal compounds;

(2) partially cooling the hot raw gas stream from (1) to a temperature in the range of about 1475° F. to 1800° F. in a gas cooling zone;

(3) separating out entrained particulate matter from the raw gas stream from (2) to produce a process gas stream;

(4) catalytically disproportionating the ammonia in the gas stream from (3) thereby producing a gas stream substantially free from $NH_3$;

(5) introducing a supplementary alkali metal compound into the $NH_3$-free gas stream to react with the gaseous hydrogen halides and hydrogen cyanide present in the gas stream; cooling the resulting gas stream to a temperature in the range of about 800° F. to 1000° F. and filtering the gas stream and separating therefrom alkali metal halides and cyanide, any remaining alkali metal compounds, and any remaining particulate matter to produce a filtered halide-free gas stream; and (6) contacting the filtered halide-free gas stream at a temperature in the range of about 1000° F. to 1250° F. with a sulfur reactive oxide containing mixed metal oxide sorbent comprising a sulfur reactive oxide portion and a sulfur non-reactive oxide portion in a sulfur-removal zone, wherein the sulfur-containing gases in the filtered halide-free gas stream react with said sulfur reactive oxide containing mixed metal oxide sorbent to produce a sulfided sorbent material; and separating said sulfided sorbent material from the gas stream to produce a clean fuel gas stream substantially free from particulate matter, $NH_3$, HCN, alkali metal compounds, HCl, HF, $H_2S$, and COS, and having a temperature of at least 1000° F.

24. The process of claim 23 wherein the process gas stream in (3) is passed through a gas/solids separation zone to reduce the concentration of particulate matter to less than 1000 parts per million by weight.

25. The process of claim 23 where in (4) said $NH_3$ is disproportionated into $N_2$ and $H_2$ while the gas stream from (3) is in contact with a nickel disproportionating catalyst at a temperature in the range of about 1475° F. to 1800° F.

26. The process of claim 23 further comprising the step of separating any remaining particulate solids from the stream of fuel gas from (6) to produce a clean product gas stream of fuel gas substantially free from particulate matter, $NH_3$, HCN, alkali metal compounds, HCl, HF, $H_2S$, COS and having a temperature of at least 1000° F.; and burning said product fuel gas stream in the combustor of a gas turbine for the production of flue gas which is free from particulate matter, alkali metal compounds, halides, sulfur-containing gases, and passing said flue gas through an expansion turbine for the production of mechanical and/or electrical power.

27. A partial oxidation process for the production of a stream of hot clean synthesis gas, reducing gas, or fuel gas substantially free from particulate matter, hydrogen halides, ammonia, hydrogen cyanide, alkali metal compounds, and sulfur-containing gases comprising:

(1) reacting a pumpable hydrocarbonaceous fuel feedstock by partial oxidation with a free-oxygen containing gas wherein said hydrocarbonaceous fuel feedstock comprises a fuel selected from the group consisting of liquid hydrocarbonaceous fuel or liquid emulsions thereof, an aqueous slurry of petroleum coke, and mixtures thereof, and wherein said fuel contains halide, alkali metal compounds, sulfur, nitrogen and inorganic ash containing components, and said fuel is reacted with a free-oxygen containing gas in a free-flow vertical refractory lined partial oxidation gas generator at a temperature in the range of about 1800° F. to 3000° F., a pressure in the range of about 2 to 300 atmospheres, a weight ratio of $H_2O$ to hydrocarbonaceous fuel in the range of about 0.1 to 5.0, and an atomic ratio of O/C in the range of about 0.7 to 1.5, to produce a hot raw gas stream having a temperature in the range of about 1800° F. to 3000° F. and comprising $H_2$, CO, $CO_2$, $H_2O$, $CH_4$, $NH_3$, HCN, HCl, HF, $H_2S$, COS, $N_2$, Ar and containing particulate matter, and vapor phase alkali metal compounds;

(2) partially cooling the hot raw gas stream from (1) to a temperature in the range of about 1475° F. to 1800° F. in a gas cooling zone;

(3) separating out entrained particulate matter from the raw gas stream from (2);

(4) catalytically disproportionating the ammonia in the stream of gas from (3) at a temperature in the range of about 1475° F. to 1800° F. and simultaneously destroying a major portion of the HCN contained therein;

(5) introducing supplementary $Na_2CO_3$ into the stream of gas from (4) to react with HCl and/or HF and any remaining HCN present in the gas stream; cooling the resulting gas stream to a temperature in the range of about 800° F. to 1000° F. and filtering and separating out NaCl and/or NaF to produce a stream of gas free from particulate matter, any remaining alkali metal compounds, HCN, HCl and/or HF;

(6) contacting the gas stream leaving (5) with zinc titanate sorbent material containing a zinc oxide portion in a sulfur-removal zone at a temperature in the range of about 1000° F. to 1250° F. and at a pressure of that in the gas generator in (1) less ordinary pressure drop in the lines, wherein the $H_2S$ and/or COS gases in the gas stream from (5) react with said zinc oxide-containing portion of said zinc titanate sorbent material to produce sulfided sorbent material; and separating said sulfided sorbent material from the gas stream to produce a clean fuel gas stream substantially free from particulate matter, $NH_3$, HCN, $Na_2CO_3$, NaCl and/or NaF, $H_2S$ and COS; and (7) separating any remaining sulfided sorbent material from the stream of clean fuel gas from (6) to produce a clean product gas stream of fuel having a temperature of at least 1000° F.; and burning the product fuel gas stream in the combustion of a gas turbine for the production of flue gas which is free from particulate matter, alkali metal compounds, halides, and sulfur-containing gases, and passing said flue gas through an expansion turbine for the production of mechanical and/or electrical power.

28. The process of claim 27 including the step of roasting said sulfided sorbent material separated in (6) and (7), and regenerating said zinc titanate sorbent for use in (6).

29. The process of claim 27 wherein the raw gas stream in (3) is passed through a gas/solids separation zone to reduce the concentration of particulate matter to less than 1000 parts per million by weight.

* * * * *